United States Patent [19]

Kidnie

[11] Patent Number: 5,028,507

[45] Date of Patent: Jul. 2, 1991

[54] INFRARED-TRANSPARENT BLACK LIQUID TONER

[75] Inventor: Kevin M. Kidnie, St. Paul, Minn.

[73] Assignee: Minnesota Mining and Manufacturing Company, St. Paul, Minn.

[21] Appl. No.: 429,151

[22] Filed: Oct. 30, 1989

[51] Int. Cl.[5] ..... G03G 13/10

[52] U.S. Cl. ..... 430/109; 430/114

[58] Field of Search ..... 430/109, 114

[56] References Cited

U.S. PATENT DOCUMENTS

| | | | |
|---|---|---|---|
| 4,145,299 | 3/1979 | Ford, Jr. et al. | 252/62.1 |
| 4,414,152 | 11/1983 | Santilli et al. | 260/185 |
| 4,654,282 | 3/1987 | Ng et al. | 430/54 |
| 4,728,983 | 3/1988 | Zwadlo et al. | 355/4 |
| 4,786,575 | 11/1988 | Macholdt et al. | 430/114 |

*Primary Examiner*—John Goodrow

*Attorney, Agent, or Firm*—Gary L. Griswold; Walter N. Kirn; James V. Lilly

[57] ABSTRACT

A black liquid toner is provided. The toner is transparent to light in the near infrared region and can be used in a half-tone color proofing. The photoconductor can be imaged through the toner. The toner comprises a mixture of a first and second pigment in a liquid carrier.

25 Claims, No Drawings

INFRARED-TRANSPARENT BLACK LIQUID TONER

FIELD OF THE INVENTION

This invention relates to liquid toners. In particular it relates to liquid toners useful in the area of color half-tone proofing.

BACKGROUND ART

Image registration for production of four color images from separations has long been a problem. In order directly on the photoconductor, it is necessary to image to expose the photoconductor through the toner after the first toner has been deposited. This necessitates that the subsequently applied toners be transparent to the exposing radiation. For reasons of practicality and economics, a single source of radiation at a single wavelength is used (e.g., a laser). However, the acceptable colorants for four color half-tone processes (particularly black toners) have no common spectral region of low absorbance (i.e., high transparency) in the range of 400–750 nm.

Solutions to this problem have heretofore been unsatisfactory. They have included exposing the backside of the photoconductor through a transparent support; the use of several wavelengths of light and the placement of the black toner last; and the transfer of the toner after each deposition. Toners which have been suggested for these solutions are known.

U.S. Pat. No. 4,145,299 discloses an electrographic liquid developer comprising a carrier and marking particles which are formed by coupling diazonium salts with 2,3-naphthalenediol derivatives. These particles are said to absorb radiation relatively uniformly in the range of 400 to 700 nanometers (nm) and exhibit neutral density coloration, that is they are black or nearly black in hue. However, these toners have not been found to be stable to extended ultraviolet or visible radiation.

U.S. Pat. No. 4,414,152 discloses bis aryl-azo compounds having a base structure similar to those of U.S. Pat. No. 4,145,299. These compounds are said to be useful as neutral density pigments in electrophotographic developers.

U.S. Pat. No. 4,654,282 discloses a method of forming a toner image by overlapping one or more previously formed toner images. Liquid developers are disclosed as being useful in the invention. Colorants which can be used in these developers include toners of the type described in U.S. Pat. No. 4,145,299 and U.S. Pat. No. 4,414,152.

The foregoing solutions have not been entirely satisfactory. They have not provided a process in which the photoconductor is exposed through the toners so that all colors can be laid down in any order then transferred at one time.

SUMMARY OF THE INVENTION

The present invention overcomes these problems. It provides a black toner that can be used in half-tone color proofing at any point in the process, and is transparent to near infrared light at a desired wavelength. As a result, all colors can be laid down in the process and then transferred.

The present invention provides a black liquid toner that is transparent to a desired wavelength in the near infrared region. The toner comprises a combination of a first and second pigment in a liquid carrier. The first pigment has the formula

FORMULA I

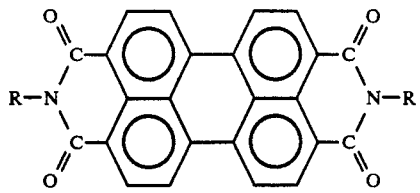

wherein each R is independently a monovalent aliphatic/aromatic or a heterocyclic group.

The second pigment has a formula selected from

FORMULA II

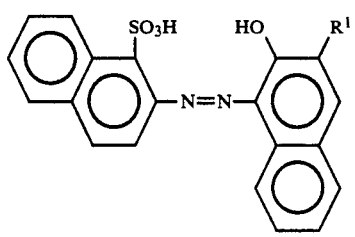

and

FORMULA III

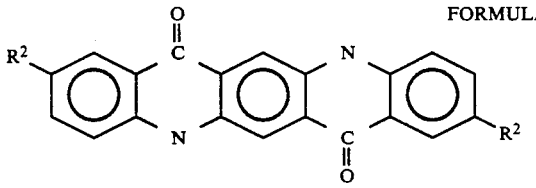

wherein $R^1$ is selected from hydrogen and -COOH and each $R^2$ is independently selected from hydrogen, methyl and Cl. The second pigment is provided as a calcium or barium salt.

As it is used herein, "black toner" means to a toner which is black, or appears to be black, in hue; and "transparent to a desired wavelength in the near infrared region" means a toner which allows a substantial portion of light in that region to pass through and which preferably has a Maximum Absorbent Ratio (defined hereinafter) of about 0.75.

DETAILED DESCRIPTION

The liquid toner of the invention is preferably provided as a dispersion of the first and second pigments in the liquid carrier. This may be achieved by a variety of techniques. For example, the pigments may be purified by sohxlet extraction with ethyl alcohol and then combined with a desired carrier liquid. Typically the carrier/pigment combination is dispersed by known techniques (e.g., such as in a Silverson mixer). Usually between 4–6 hours of mechanical dispersion is adequate to obtain the desired pigment particle size in the dispersion. The preferred particle size is less than 1 micrometer (μm) in major dimension. More preferably the particle size is in the range of from 0.1 μm to 0.5 μm. Preferably the temperature of the carrier/pigment combination is maintained at 80° C. or less during the dispersion process.

The first pigment useful in the invention has Formula I as identified above. R in this formula consists of an aliphatic/aromatic group (preferably containing from 1 to 10 carbon atoms) in the aliphatic portion, a heterocyclic group or an aromatic/heterocyclic group. The aliphatic groups may contain heteroatoms such as oxygen and nitrogen.

Specific examples of useful R groups include

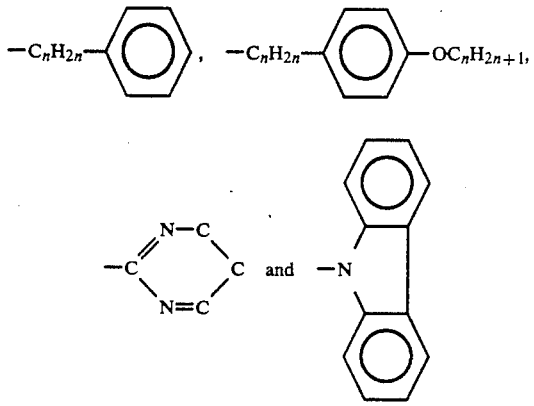

wherein n is an integer of from 1 to 10.

The second pigment useful in the invention has Formula II as identified above.

The weight ratio of the first pigment to the second pigment is preferably in the range of from 2/1 to 5/1 and most preferably in the range of 3/1 to 4/1.

The liquid carrier useful in the invention can be selected from a wide variety of materials. Preferably, the liquid has a low dielectric constant and a very high electrical resistance such that it will not disturb or destroy the electrostatic latent image. In general, useful carrier liquids should have a dielectric constant of less than about 3, should have a volume resistivity of greater than about $10^{10}$ ohm-cm., and should be stable under a variety of conditions. Suitable carrier liquids include halogenated hydrocarbon solvents, for example, fluorinated lower alkanes, such as trichloromonofluoromethane, trichlorotrifluoroethane, etc., having a typical boiling range of from about 2° C. to about 55° C. Other hydrocarbon solvents are useful, such as isoparaffinic hydrocarbons having a boiling range of from about 145° C. to about 185° C., such as Isopar G (Humble Oil & Refining Co.) or cyclohydrocarbons having a major aromatic component and also having a boiling range of from about 145° C. to about 185° C., such as Solvesso 100 (Humble Oil & Refining Co.). Additional useful carrier liquids include polysiloxanes, odorless mineral spirits, octane, cyclohexane, etc.

The liquid carrier typically comprises from about 0.05 to 2 weight percent of the liquid toner composition. Preferably it comprises from 0.1 to 1 weight percent and most preferably from 0.2 to 0.7 weight percent.

The toners of the invention are useful in a variety of processes. However, they are particularly useful in color half-tone proofing processes. These processes are employed to minimize problems of image registration in the production of multi-color images from separations. An example of such a process disclosed in U.S. Pat. No. 4,728,983.

The toners of the invention are black, or black appearing. They preferably have a Maximum Absorbance Ratio of X of 0.75. X is calculated according to the formula where $A_{IR}$ is the absorbance of the toner at a desired wavelength in the near infrared region and $A_{VIS}$ is the absorbance of the toner at a desired wavelength in the visible region. At values of X above 0.75 appreciable absorption of light in the near infrared region begins to occur. This means that longer exposure times are needed to achieve a given image density. Consequently, the process becomes less economical to run. More preferably the value of X is at most 0.6 and most preferably it is at most 0.4.

Preferably the desired wavelength in the near infrared region is from 750 nm to 1000 nm. Most preferably it is about 830 nm. Preferably the desired wavelength in the visible region is from 400 nm to 750 nm. Most preferably it has a wavelength of about 570 nm.

Absorbance is measured at ambient temperature, pressure and humidity using a sample of the liquid toner which has been diluted to from 0.005 to 0.01 weight percent solids in the carrier liquid. The measurements are made directly on the diluted toner using a Perkin-Elmer Model 330 Spectrophotometer. Images produced with the toner of the invention have a reflection optical density maximum ($ROD_m$) in the range of from 0.75 to 2.2 per single development step. Subsequent development steps will increase $ROD_m$. $ROD_m$ values of 3 or greater can be readily achieved with the toner of the invention through the use of multiple development steps.

In addition to serving as a toner useful in color-proofing, the present toner can be used to form masks for lithographic work. In this process, the toner of the invention is superimposed via multiple depositions with substantially complete registration to provide an image having a $ROD_m$ of 3 or more.

ROD is measured after the toner has been used to develop an image. The process of U.S. 4,728,938 can be used to provide the image. The image is applied to a white substrate or base. ROD is measured from the image using a standard reflection densitometer such as a Macbeth TR 524.

The following examples further illustrate the present invention.

EXAMPLES 1-5

A series of black toner powders according to the invention were prepared. It consisted of 2 parts by weight Paliogen TM Black (BASF Co., 14.8 % solids dispersion in Isopar TM G), and 0.7 parts by weight Quinacridone (Harmon Color Co., 15.2 % solids dispersion in Isopar G) with a polymer colloid organosol. The polymer of the organosol consisted of polyethylacrylate (PEA) stabilized in the Isopar TM by polylaurylmethacrylate (PLMA) at a weight ratio of 2:1 PEA:PLMA. The toner was prepared by high speed milling in a Silverson mixer. A weight ratio of 1:4 pigment combination to organosol in Isopar ®G was utilized.

Some of the toners included varying amounts of carbon black (Cabot Regal 300 R Carbon Black from Cabot Corporation). The carbon black-containing toners were prepared using the same techniques as those that were free from carbon black.

All toners were then tested in a negative acting organic photoconductor system using the process described in U.S. Pat. No. 4,728,983. An initial uniform non-image deposition of each toner was first laid down at a ROD of about 1. Then each toner of the examples was used for subsequently imaging over the initially deposited layer. The results of these tests are set out in Table I.

TABLE I

| EX | CARBON BLACK (%) | X | $V_{EXP}$ (volts) | $V_{Bias}$ (Volts) | V (Volts) | ROD |
|---|---|---|---|---|---|---|
| Photoconductor | | — | 90 | — | — | — |
| 1 | 0 | 0.35 | 90 | 640 | 550 | 1.80 |
| 2 | 1 | 0.51 | 110 | 640 | 530 | 1.76 |
| 3 | 5 | 0.56 | 120 | 640 | 520 | 1.74 |
| 4 | 10 | 0.59 | 155 | 640 | 485 | 1.69 |
| 5 | 15 | 0.67 | 185 | 640 | 455 | 1.62 |

$X = A_{830/A570}$
$V_{EXP}$ = Photoconductor discharge voltage
$V_{Bias}$ = Toner development voltage
$V = V_{Bias} - V_{EXP}$
ROD = *Reflection Optical Density*

This data shows that addition of an absorbing carbon black will result in a drop of ROD in multitoned images but that at least up to 15% by weight can be utilized in the toners of the invention.

COMPARATIVE EXAMPLE

A Toner employing Regal 300 R Carbon black from Cabot Corporation in place of the Quinacridone and the Paliogen. Otherwise the formulation of the toner and its method of manufacture was as described in Examples 1-5. The toner was then used as described in Examples 1-5 and the results compared with the results obtained using the toner of Example 1. All results are given in Table II.

TABLE II

| TONER | IMAGE PASS | ROD | % INCREASE | X |
|---|---|---|---|---|
| C-1 | 1ST | 0.95 | — | 0.79 |
| C-1 | 2ND | 1.05 | 10.5 | — |
| EX1 | 1ST | 0.95 | — | 0.35 |
| EX2 | 2ND | 1.8 | 89.5 | — |

These data show that the toner of the invention provides an 89.5% increase in ROD while the comparative example allows only a 10.5% increase. This is because the toner of the invention is transparent to light in the near infrared region, thereby allowing more toner to be deposited on the second image pass.

I claim:

1. A black liquid toner that is transparent to a desired wavelength of electromagnetic radiation in the near infrared region, said toner being comprised of a combination of (a) a first pigment having the formula

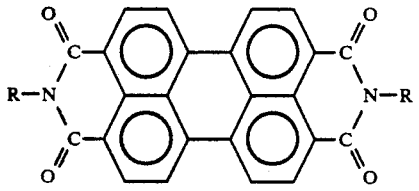

wherein R is a monovalent radical selected from the group consisting of aliphatic/aromatic, aromatic/heterocyclic and heterocyclic groups, (b) a second pigment comprising a calcium or barium salt of a compound having the formula

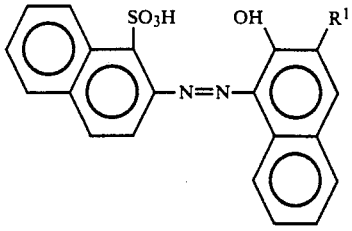

or

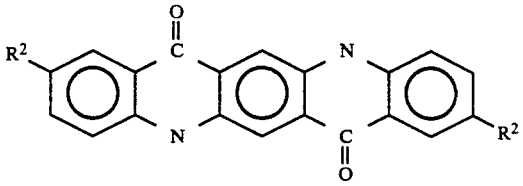

wherein $R^1$ is selected from hydrogen and -COOH and $R^2$ is selected from hydrogen, methyl and Cl, and (c) a liquid carrier for said first and second pigments, wherein the weight ratio of said first pigment to said second pigment is in the range of from about 1.51 to 7/1.

2. A liquid toner according to claim 1 wherein R is selected from the group consisting of

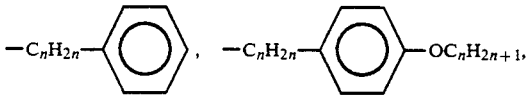

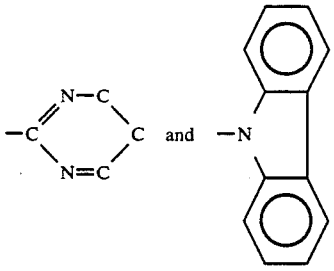

wherein n is an integer of from 1 to 10.

3. A liquid toner according to claim 1 wherein said liquid toner has a maximum absorbance ratio, X, of about 0.75, wherein X is calculated according to the formula:

$$\frac{A_{IR}}{A_{VIS}}$$

wherein $A_{IR}$ is the absorbance of said liquid toner at a predetermined wavelength in the near infrared region, and $A_{VIS}$ is the absorbance of said liquid toner at a predetermined wavelength in the visible region.

4. A liquid toner according to claim 3 wherein said predetermined wavelength range in the near infrared region is from about 750 to 1000 nanometers.

5. A liquid toner according to claim 4 wherein said predetermined wavelength is about 830 nanometers.

6. A liquid toner according to claim 3 wherein said predetermined wavelength in the visible region is in the range of from about 400 to 750.

7. A liquid toner according to claim 6 wherein said predetermined wavelength in the visible region is 570 nanometers.

8. A liquid toner according to claim 3 wherein said predetermined wavelength in the near infrared region is 830 nanometers and said predetermined wavelength in the visible region is 570 nanometers.

9. A liquid toner according to claim 3 wherein X is at most 0.6.

10. A liquid toner according to claim 3 wherein X is at most 0.4.

11. A liquid toner according to claim 1 wherein said liquid carrier is selected from the group consisting of halogenated hydrocarbon solvents, isoparaffinic hydrocarbon solvents, cyclohydrocarbon solvents, polysiloxanes, mineral spirits, octane, and cyclohexane.

12. A liquid toner according to claim 11 wherein said liquid carrier is selected from the group consisting of trichloromonofluoromethane, trichlorotrifluoroethane.

13. A liquid toner according to claim 11 wherein said liquid carrier is an isoparaffinic hydrocarbon having a boiling range of from 145° C. to about 185° C.

14. A liquid toner according to claim 11 wherein said liquid carrier has a low dielectric constant and a high electrical resistance.

15. A liquid toner according to claim 14 wherein said liquid carrier has a dielectric constant of less than about 3 and a volume resistivity of greater than $10^{10}$ ohm-cm.

16. A substrate having a surface, said surface having formed thereon a region resulting from the deposition of a liquid toner according to claim 1.

17. A substrate according to claim 16 wherein said substrate is formed of a polymeric material.

18. A substrate according to claim 16 wherein said substrate is transparent.

19. A substrate according to claim 16 wherein said substrate is formed of paper.

20. A substrate according to claim 16 said substrate having been used in a color-proofing process and further wherein said region on said substrate surface has a reflection optical density maximum of at least 0.75 per single development step of said color-proofing process.

21. A substrate, said substrate having deposited thereon in a discrete area, a dried liquid toner according to claim 1.

22. A substrate according to claim 21 wherein said discrete area of dried liquid toner has a reflection optical density maximum of at least 0.75.

23. A substrate according to claim 21 wherein said discrete area of dried liquid toner has a reflection optical density maximum of at least 3.

24. A liquid toner that is transparent to a desired wavelength of electromagnetic radiation in the near infrared region, said toner being comprised of a combination of (a) a first pigment having the formula

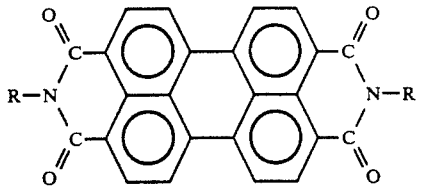

wherein R is a monovalent radical selected from the group consisting of aliphatic/aromatic, aromatic/heterocyclic and heterocyclic groups, and further wherein if R comprises aliphatic/aromatic groups, said groups are bonded to the nitrogen atoms of said first pigment through the aliphatic structure, (b) a second pigment comprising a calcium of barium salt of a compound having the formula

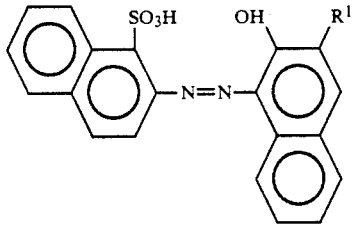

or

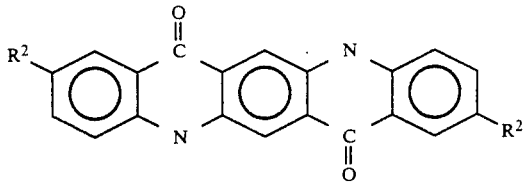

wherein $R^1$ is selected from hydrogen and -COOH and $R^2$ is selected from hydrogen, methyl and Cl, and (c) a liquid carrier for said first and second pigments, wherein the weight ratio of said first pigment to said second pigment is in the range of from about 1.51 to 7/1.

25. A liquid toner according to claim 24 wherein said toner is black.

* * * * *

UNITED STATES PATENT AND TRADEMARK OFFICE

CERTIFICATE OF CORRECTION

PATENT NO. : 5,028,507

DATED : July 2, 1991

INVENTOR(S) : Kevin M. Kidnie

It is certified that error appears in the above-identified patent and that said Letters Patent is hereby corrected as shown below:

Col. 1, line 13, before the word "directly," insert --to image--.

Col. 1, line 14, after the word "necessary," delete --to image--.

Col. 3, line 65, after the word "formula," insert $$-- \frac{A_{IR}}{A_{VIS}} --$$

Col. 4, line 45, "TM" should read --™--.

Col. 4, line 46, "TM" should read --™--.

Col. 4, line 48, "Isopar" should read --Isopar™--.

Col. 4, line 50, "TM" should read --™--.

Col. 4, line 54, "®" should read --™--.

Col. 8, line 23, "of" should read --or--.

Signed and Sealed this

Twenty-seventh Day of April, 1993

*Attest:*

MICHAEL K. KIRK

*Attesting Officer*

*Acting Commissioner of Patents and Trademarks*